US008925649B1

(12) United States Patent
Wiebe et al.

(10) Patent No.: US 8,925,649 B1
(45) Date of Patent: Jan. 6, 2015

(54) SYSTEM TO HARVEST ENERGY IN A WELLBORE

(71) Applicant: Focus Tools Colorado, LLC, Denver, CO (US)

(72) Inventors: Darcy L. Wiebe, Denver, CO (US); Rene M. Rey, Denver, CO (US)

(73) Assignee: Focus Tools Colorado, LLC, Denver, CO (US)

( * ) Notice: Subject to any disclaimer, the term of this patent is extended or adjusted under 35 U.S.C. 154(b) by 0 days.

(21) Appl. No.: 14/494,463

(22) Filed: Sep. 23, 2014

(51) Int. Cl.
*E21B 7/24* (2006.01)
*H02N 2/18* (2006.01)
*E21B 41/00* (2006.01)

(52) U.S. Cl.
CPC ..... *E21B 41/0085* (2013.01)
USPC ..... 175/56; 175/93; 175/106; 310/339

(58) Field of Classification Search
USPC ..... 175/56, 93, 106; 310/339, 319
See application file for complete search history.

(56) References Cited

U.S. PATENT DOCUMENTS

| | | | | |
|---|---|---|---|---|
| 5,934,882 | A * | 8/1999 | Olney et al. | 417/233 |
| 7,982,370 | B2 * | 7/2011 | Wang et al. | 310/339 |
| 8,410,667 | B2 * | 4/2013 | Rastegar et al. | 310/339 |
| 8,564,178 | B2 * | 10/2013 | Hsu et al. | 310/339 |
| 2009/0038848 | A1 * | 2/2009 | Garcia-Osuna | 175/40 |

* cited by examiner

*Primary Examiner* — Kenneth L Thompson
*Assistant Examiner* — Wei Wang
(74) *Attorney, Agent, or Firm* — Buskop Law Group, PC; Wendy Buskop

(57) ABSTRACT

A system to harvest mechanical energy in a wellbore, wherein the mechanical energy comes from motion. The system uses mechanical energy coming from at least one of: motion of a drill bit, motion of a drill string, motion of flowing air or drilling mud down the drill string to the drill bit and up an annulus between the drill string and the wellbore, motion of a bottom hole assembly connected to the drill string. The system can include a plurality of piezoelectric stand bundles, wherein each individual piezoelectric strand can vibrate as the pressure housing moves in the wellbore, thereby producing electricity.

15 Claims, 5 Drawing Sheets

SYSTEM TO HARVEST ENERGY IN A WELLBORE

FIELD

The present embodiments generally relate to a system to harvest energy in a wellbore containing a drill string comprising interconnected tubulars.

BACKGROUND

Power for use in a downhole environment has generally in the past been either stored in a battery and conveyed downhole or the power has been transmitted via conductors, such as a wireline, from the space or another remote location. Batteries have the capability of storing only a finite amount of power therein and have environmental limits, such as temperature, on their use.

Electrical conductors, such as those in a conventional wireline, provide a practically unlimited amount of power, but require special facilities at the surface for deployment. These facilities typically block the production flow path (i.e., limiting the flow rate of fluids through the flow path) while the conductors are in the flow path. Thus, wireline operations are typically carried out prior to the production phase of a well or during remedial operations after the well has been placed into production.

In wellbore drilling operations, one or more efficient power sources are desirable to power downhole instrumentation. A wide variety of devices can use mechanical energy in order to perform work downhole. Those devices may be subject to a variety of forces and can release energy in a number of ways.

A need exists for a system of harvesting mechanical energy downhole and generating electrical power therefrom. A need exists for a system to harvest energy in a wellbore containing a drill string.

The present embodiments meet these needs.

BRIEF DESCRIPTION OF THE DRAWINGS

The detailed description will be better understood in conjunction with the accompanying drawings as follows.

Figure 1:
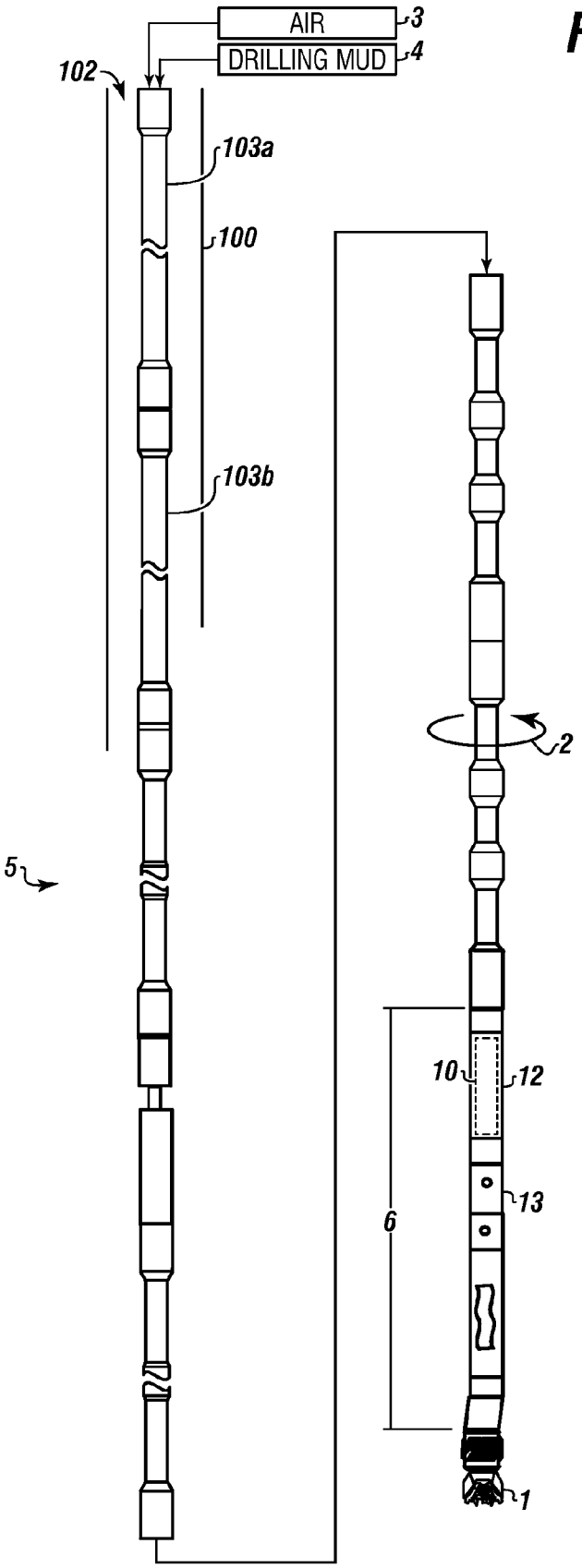
FIG. 1 depicts a drill string in a wellbore according one or more embodiments.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments relate to systems to harvest energy in a wellbore containing a drill string using an enclosed waterproof hermetic pressure housing connected between a drilling collar and a universal bottom hole orientation (UBHO) sub assembly.

The pressure housing can be adapted to sustain an external pressure of at least 20,000 psi and maintain an internal pressure of about 1 atm. The pressure housing can be an enclosed waterproof hermetic pressure housing.

The internal chamber of the pressure housing can contain a pendulous member. One or more piezoelectric strand bundles can each be secured to the pendulous member. These piezoelectric strand bundles can vibrate and produce electricity as the pressure housing moves in the wellbore as a component of the drill string.

Electrodes can be connected to the piezoelectric strand bundles and receive electricity produced from the piezoelectric strand bundles. Each electrode can flow power from the piezoelectric strand bundles to a power conditioning circuit.

A power conditioning circuit is used to normalize the electricity received by the electrodes to within a predetermined range. This power conditioning circuit can be electrically connected to one or more energy storage devices.

The energy storage devices can be connected in series and receive the power from the power conditioning circuit within a predetermined range. Each energy storage device can contain a high temperature electrolytic double layer capacitor. Each high temperature electrolytic double layer capacitor can be adapted to sustain operating temperatures from −40 degrees Celsius to 300 degrees Celsius without damage, thereby forming a magnet free system for harvesting electricity while operating in a wellbore.

A benefit of the present embodiments is that the power is produced on site, thereby bypassing the transportation restrictions of fuel cells and lithium batteries. Further, the present embodiments provide power during quiet times of the bottom hole assembly.

A benefit of the present embodiments is that no lithium batteries, which can explode, are needed. Lithium batteries can cause huge fires at a drill site, or another work over location, and the present embodiments prevent such explosions. Further, when the tool is being tested, there is no possibility of explosion by a lithium battery, as the tool has no lithium battery.

A benefit of the present embodiments is that it is usable for operating measure-while-drilling equipment while drilling in a wellbore.

A benefit of the present embodiments is that it prevents death at a drill site by enabling fewer trips out of the hole, thereby creating a safer environment for field hands at a drill site. A benefit of the present embodiments is that it prevents broken bones and other serious injuries by avoiding explosions.

The embodied systems are directed at harvesting energy in a wellbore. A pressure housing, typically waterproof and hermetically sealed, can be connected between a drilling collar and a sub assembly. Within the internal chamber of the pressure housing, a pendulous member can be anchored. The pendulous member can swing in a pendulum motion as the pressure housing moves in the wellbore.

Piezoelectric strand bundles, which can be comprised of individual piezoelectric strands of various lengths, can be secured to the pendulous member by an anchor. The piezoelectric strand bundles can swing freely in parallel with the pendulous member. The individual piezoelectric strands can vibrate as the pressure housing moves in the wellbore, thereby producing electricity. The electricity can flow to electrodes galvanically connected to the piezoelectric strand bundles and then to energy storage devices.

The systems can include a power conditioning circuit connected between the electrodes and the energy storage devices. The power conditioning circuit normalizes electricity from the electrodes and provides a voltage to the energy storage device within a predetermined range. A buck boost converter can be added to accept a range of input voltage levels less than a preset range and more than a preset range, and provide a voltage output within a predetermined output voltage range.

Turning now to the Figures, FIG. 1 depicts a drill string 5 in a wellbore 100 accordingly to one or more embodiments.

The drill string 5 can be made up of interconnected tubulars 103*a* and 103*b*. In embodiments, the drill string can be from a few feet to several miles in length.

A pressure housing 10 can be located within a drilling collar 12 and secured to a sub assembly 13 of a bottom hole assembly 6. The bottom hole assembly 6 can be connected to the drill string 5 proximate the drill bit 1. The sub assembly can be a universal bottom hole orientation (UBHO) sub assembly.

In embodiments, the pressure housing can be from 2 feet to 6.5 feet. The pressure housing can have a diameter from 1.875 inches to slightly less than the diameter of the tubulars used for the drill string. The pressure housing can be made from copper beryllium, such as TOUGHMET™, a copper alloy made by Materion of Michigan and Illinois. The pressure housing can be comprised of any suitable non-magnetic material. In embodiments, the pressure housing can have a coating disposed on the outside. The pressure housing 10, which can be waterproof and hermetically sealed, can be adapted to sustain external pressures of at least 20,000 psi while simultaneously maintaining an internal chamber pressure of around 1 atmosphere (atm) or another normal atmospheric pressure.

The drill string 5 can rotate and have a motion 2 of a drill string. Air 3 can flow into the drill string 5. The air 3 can be an air and foam mixture used for air drilling. Drilling mud 4 can also flow into the drill string 5. The air and the drilling mud can flow down the connected tubulars to a drill bit 1 and up an annulus 102 between the drill string 5 and the wellbore 100.

Figure 2:
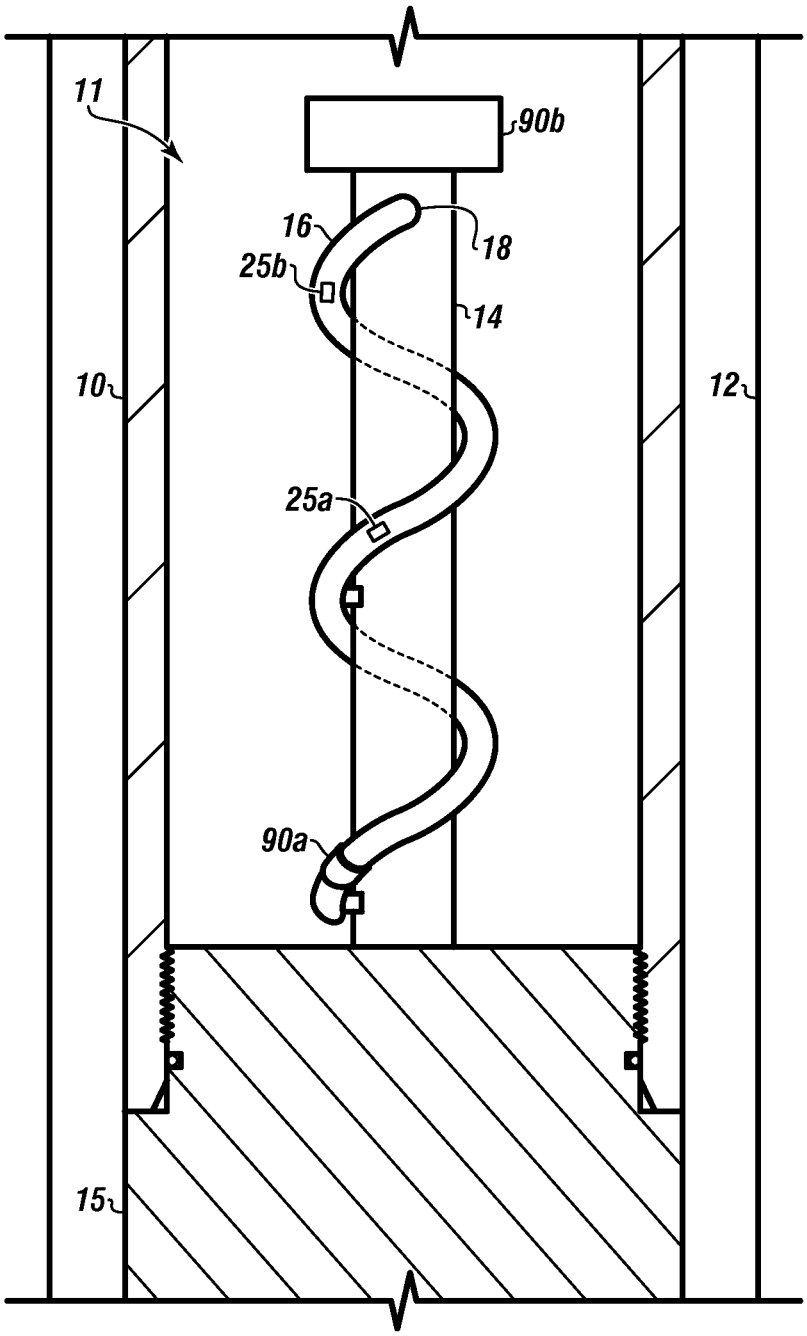
FIG. 2 depicts a cross sectional view of the portion of the system that harvests mechanical motion from movement while drilling according one or more embodiments.

FIG. 2 depicts a cross sectional view of the portion of the system that harvests the mechanical motion from movement while drilling accordingly to one or more embodiments.

The system harvests the mechanical energy coming from at least one of a motion of a drill bit, a motion of a drill string, a motion of flowing air or drilling mud down the drill string to the drill bit and up an annulus between the drill string and the wellbore, and a motion of a bottom hole assembly connected to the drill string.

The pressure housing 10 can have an internal chamber 11.

The pressure housing 10 can be inside a drilling collar 12 and connected to a sub assembly. In embodiments, the pressure housing can connect to a bulkhead 15 which attaches to the sub assembly 13.

In embodiments, the pressure housing 10 can have a diameter from 20 percent to 95 percent less than a diameter of the drilling collar 12.

Within the internal chamber 11 can be a pendulous member 14 anchored on one end within the internal chamber 11. The pendulous member is shown anchored to the bulkhead 15.

The pendulous member 14 can be adapted to swing in a pendulum motion with the mechanical energy coming from at least one: motion of a drill bit, motion of a drill string, motion of flowing air or drilling mud down the drill string to the drill bit and up an annulus between the drill string and the wellbore, and motion of a bottom hole assembly connected to the drill string.

In embodiments, the pendulous member 14 can be cylindrical. In embodiments, the pendulous member can have another shape. Examples of other shapes can include a dog bone shape, a cylinder shape, a ball shape on a rod, an extended longitudinally curvilinear object, a cable with a deadweight on a freely swinging end, or combinations thereof.

In embodiments, two or more pendulous members can be within the internal chamber 11.

A piezoelectric strand bundle 16 can be secured to the pendulous member 14 on one end.

An anchor 18 can be used to secure the piezoelectric strand bundle 16 to the pendulous member 14. Multiple anchors can be used at intervals appropriate to the bundle lengths in order to exploit nodal peaks and valleys according to excitation frequencies.

In embodiments, both ends of the piezoelectric strand bundle 16 can be anchored to the pendulous member 14. In embodiments, each piezoelectric strand bundle 16 can be adapted to freely swing in parallel with the swinging of the pendulous member 14.

The piezoelectric strands within the piezoelectric strand bundles 16 can vibrate as the pressure housing 10 moves in the wellbore. In embodiments, the piezoelectric strands can be made of a piezoelectric fiber-composite material. In embodiments, each piezoelectric strand can have a diameter from a few thousandths of an inch to a few tenths of an inch. The lengths of the piezoelectric strands can range from a few inches to 10 feet. In embodiments, from 2 to 100 piezoelectric strands can be in a piezoelectric strand bundle.

In embodiments, a weight 90*a* can be secured to each of the piezoelectric strand bundles to increase the coefficient of transfer of energy from the strands of piezoelectric material to the electrodes. In embodiments, a weight 90*b* can be secured to the pendulous member 14 to tune the effect of the vibration on the strands of piezoelectric material.

Tuning to frequencies is a significant and unexpected benefit of this system. Tuning can be performed by the system using the weight and calculating a ratio of components of the strand bundle to accommodate acoustic frequencies produced by the drilling equipment.

An example of the tuning ratio can be 10:13:20 which represents: a mass of the weight (10 ounces): a number of piezoelectric strands (13 strands) in a piezoelectric strand bundle: and a length of piezoelectric strands (20 inches) in the piezoelectric strand bundle.

In embodiments, the piezoelectric strands can be disposed equidistantly around the pendulous member 14.

A plurality of electrodes 25*a* and 25*b* can be attached to the piezoelectric strand bundle 16 and receive electricity produced by vibrations of the piezoelectric strands in the piezoelectric strand bundle. Multiple electrodes can be used and spaced along the piezoelectric strand bundle length to better exploit nodal peaks and valleys according to excitation frequencies.

Figure 3:
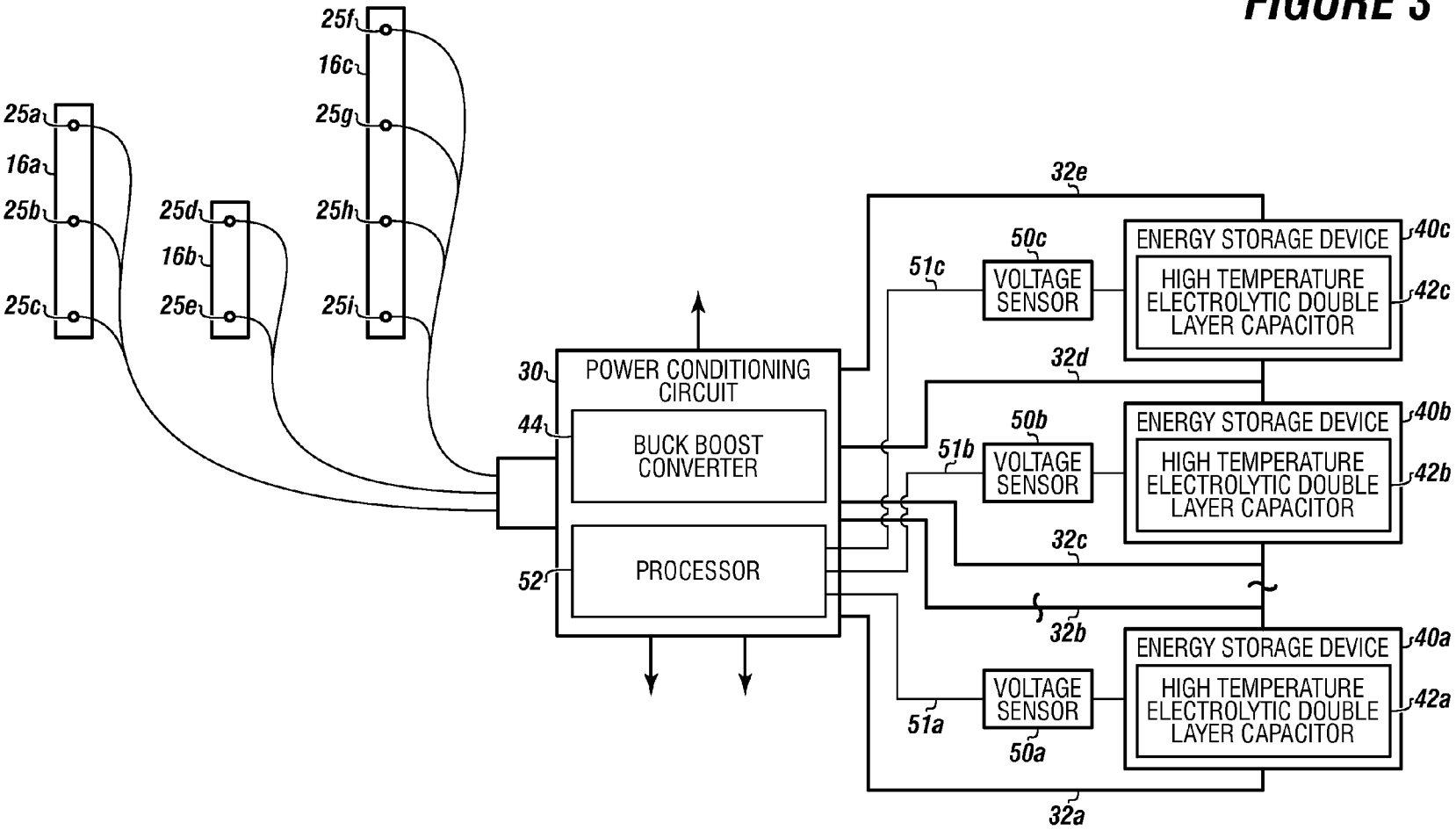
FIG. 3 depicts a block diagram of the electrical system according one or more embodiments.

FIG. 3 depicts a block diagram of the electrical system accordingly to one or more embodiments.

A plurality of piezoelectric strand bundles 16*a*-16*c* are depicted. Each piezoelectric strand bundle is shown having a different length. Each piezoelectric strand bundle can be galvanically connected to at least two electrodes.

The plurality of electrodes 25*a*-25*i* are shown. Each electrode can receive electricity produced by vibrating piezoelectric strands in each piezoelectric strand bundle. The electricity gathered by the electrodes can be directed to a power conditioning circuit 30. The power conditioning circuit can normalize the electricity from each of the electrodes and provide a voltage 32*a*-32*e* within a predetermined range. The voltages can range from 20 volts to 200 volts.

The vibrating piezoelectric strands can produce alternating current (A/C current).

In embodiments, the power conditioning circuit 30 can include a buck boost converter 44. The buck boost converter 44 can accept a range of input voltage levels less than the 20 volt to 200 volt preset range and more than the 20 volt to 200 volt preset range and provide a voltage output within a predetermined output voltage range. Usable buck boost converters can be made by Focus Tools of Colorado, LLC.

The voltage output range can be modifiable by an operator using a processor 52. The processor can be an embedded microprocessor.

In embodiments, the voltage output can be as low as 60 volts and high as 220 volts.

The power conditioning circuit 30 can monitor and control inputs from the electrodes and monitor and control voltage.

The voltage 32*a*-32*e* can be sent to energy storage devices 40*a*-40*c*. In an embodiment, each energy storage device can contain a high temperature electrolytic double layer capacitor 42*a*-42*c*.

Each high temperature electrolytic double layer capacitor can be adapted to sustain operating temperatures from −40 degrees Celsius to 300 degrees Celsius without being damaged.

The system can form a magnet free system for harvesting electricity while operating in a wellbore.

In embodiments, at least one voltage sensor 50*a*-50*c* can transmit voltage signals 51*a*-51*c* to the processor 52 of the power conditioning circuit 30. The processor 52 can balance voltage between energy storage devices 40*a*-40*c* as each of the energy storage devices charges and discharges power.

The energy storage devices can be connected in series for receiving voltage 32*a*-32*e* from the power conditioning circuit 30 within a predetermined range. The energy storage devices are not lithium batteries. The energy storage devices replace explosive and dangerous lithium batteries currently used in powering measurement while drilling systems.

Figure 4:
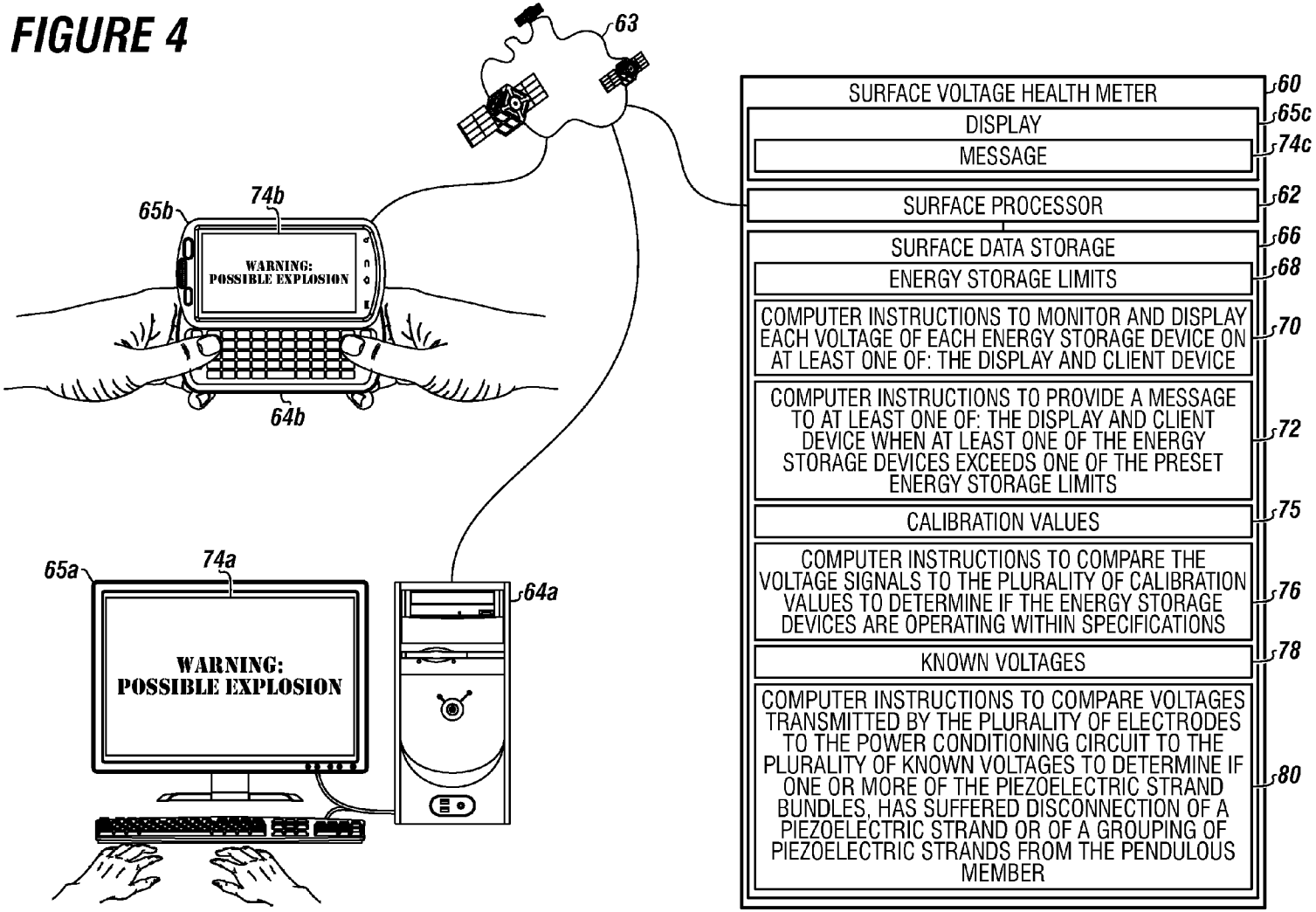
FIG. 4 depicts a diagram of a surface voltage health meter usable at the surface and outside of the wellbore according one or more embodiments.

FIG. 4 depicts a diagram of the surface voltage health meter 60 usable at the surface and outside of the wellbore accordingly to one or more embodiments.

The surface voltage health meter 60 can have a display 65*c* for presenting a message 74*c* to a user, such as a warning of a dangerous downhole condition or status of power downhole. The surface voltage health meter 60 can monitor and display the voltage of each energy storage device.

The surface voltage health meter 60 can have a surface processor 62 in communication with at least one client device 64*a* and 64*b*. Client device 64*a* is shown as a desk top computer and client device 64*b* is shown as a handheld device.

The surface processor 62 can communicate via a network 63. The network 63 can be a cellular network, a satellite network, a local area network, a wide area network, a fiber optic network, or the Internet. The network can communicate between the surface processor and the client devices in a wired or wireless manner. The processor can be used to execute computer instructions in a surface data storage.

Each client device 64*a* and 64*b* can have a display 65*a* and 65*b* respectively and messages 74*a* and 74*b* can be viewed on the displays.

The surface health meter 60 can have a surface data storage 66. The term "data storage" refers to a non-transitory computer readable medium, such as a hard disk drive, solid state drive, flash drive, tape drive, and the like. The term "non-transitory computer readable medium" excludes any transitory signals but includes any non-transitory data storage circuitry, e.g., buffers, cache, and queues, within transceivers of transitory signals.

The surface data storage 66 can include energy storage limits 68.

The surface data storage 66 can include computer instructions 70 to monitor and display each voltage of each energy storage device on at least one of: the display and the client device. The voltage can be shown on the display of the surface health meter and/or can be sent to one or more client devices.

If at least one of the energy storage devices exceeds one of the energy storage limits, the surface health meter can send a message, such as "warning imminent explosion," to the display of the surface health meter and/or to one or more client devices.

The surface data storage 66 can include computer instructions 72 to provide a message to at least one of: the display and client device when at least one of the energy storage devices exceeds one of the preset energy storage limits.

In embodiments, the surface data storage 66 can include calibrations values 75.

The surface data storage 66 can include computer instructions 76 to compare the voltage signals from the electrodes to the plurality of calibrations values to determine if the energy storage devices are operating within specifications.

If at least one of the voltage signals exceeds one of the preset calibrations values, the surface health meter can send a message such as "warning imminent explosion," to the display of the surface health meter and/or to one or more client devices.

In embodiments, the surface data storage 66 can include known voltages 78 for each piezoelectric strand bundle.

The surface health meter 60 compares the voltage signals from the electrodes to the known voltages 78.

If at least one of the voltage signals exceeds one of the known voltages, the surface health meter can send a message, such as "warning imminent explosion," to the display of the surface health meter and/or to one or more client devices.

The surface data storage 66 can include computer instructions 80 to compare voltages transmitted by the plurality of electrodes to the power conditioning circuit to the plurality of known voltages to determine if one or more of the piezoelectric strand bundles, has suffered disconnection of a piezoelectric strand or of a grouping of piezoelectric strands from the pendulous member.

Figure 5:
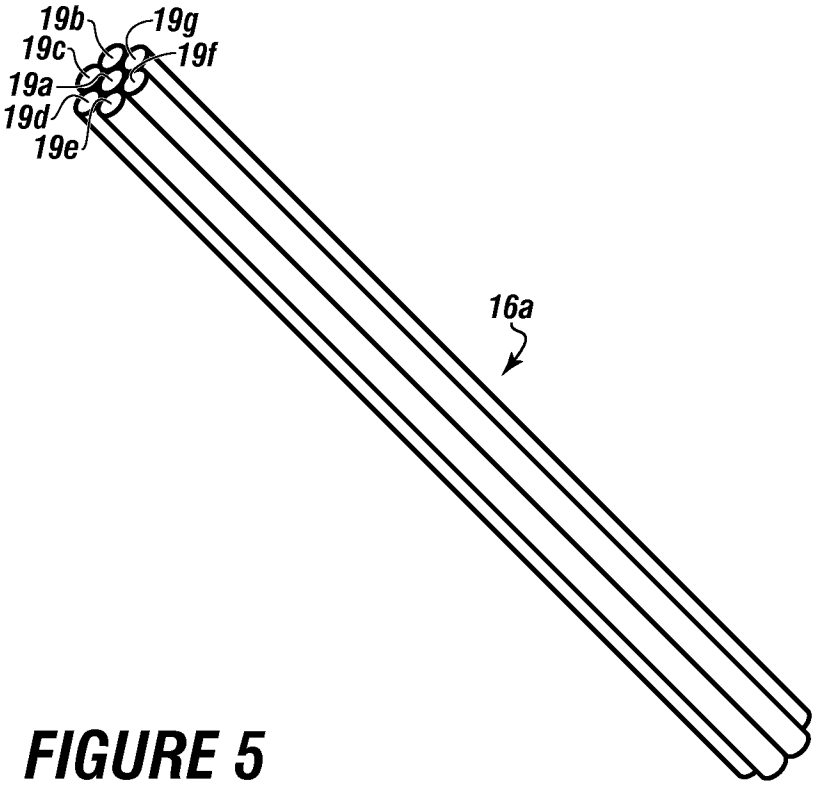
FIG. 5 depicts a piezoelectric strand bundle with a plurality of piezoelectric strands according one or more embodiments.

FIG. 5 depicts a piezoelectric strand bundle 16*a* with a plurality of piezoelectric strands 19*a*-19*g* accordingly to one or more embodiments.

While these embodiments have been described with emphasis on the embodiments, it should be understood that within the scope of the appended claims, the embodiments might be practiced other than as specifically described herein.

What is claimed is:

1. A system to harvest mechanical energy in a wellbore, wherein the mechanical energy comes from motion, the system comprising:

a. a pressure housing with an internal chamber, wherein the pressure housing is inside a drilling collar and connected to a sub assembly;

b. a pendulous member anchored to the internal chamber, wherein the pendulous member is configured to swing in a pendulum motion as the motion is transferred to the pendulous member from at least one of:

(i) a drill bit;

(ii) a drill string;

(iii) air as the air moves down the drill string to the drill bit and up an annulus between the drill string and the wellbore;

(iv) drilling mud as the drilling mud moves down the drill string to the drill bit and up the annulus between the drill string and the wellbore; and (v) a bottom hole assembly connected to the drill string;

c. a plurality of piezoelectric strand bundles, wherein each of the piezoelectric strand bundles is secured to the pendulous member, wherein each of the piezoelectric strand bundles is adapted to swing freely and in parallel with the pendulous member, and wherein each piezoelectric strand bundle comprises a plurality of piezoelectric strands, each piezoelectric strand vibrating as the motion is transferred to the pendulous member;

d. a plurality of electrodes, wherein at least two electrodes are connected to each of the piezoelectric strand bundles to receive electricity produced by vibrations of each of the piezoelectric strand; and e. at least one energy storage device for receiving a voltage from the plurality of electrodes.

2. The system of claim 1, further comprising a power conditioning circuit connected to the plurality of electrodes, wherein the power conditioning circuit normalizes electricity from the plurality of electrodes and provides the voltage to the at least one energy storage device within a predetermined range, and wherein the power conditioning circuit comprises a processor.

3. The system of claim 2, wherein the power conditioning circuit comprises a buck boost converter configured to accept a range of input voltage levels less than a preset range and more than a preset range, wherein the buck boost converter is configured to provide a voltage output within a predetermined output voltage range.

4. The system of claim 2, further comprising at least one voltage sensor, wherein the at least one voltage sensor is connected to the at least one energy storage device, and wherein the at least one voltage sensor is configured to transmit voltage signals to the power conditioning circuit.

5. The system of claim 1, further comprising a surface voltage health meter comprising a surface processor connected to a surface data storage, wherein the surface data storage comprises:

a. preset energy storage limits;

b. computer instructions to instruct the processor to monitor and display each voltage of the at least one energy storage device on at least one of: at least one display, at least one client device, or the at least one display and the at least one client device; and c. computer instructions to instruct the processor to provide a message to at least one of: the at least one display, the at least one client device, or both the at least one display and the at least one client device when the energy storage device exceeds one of the preset energy storage limits.

6. The system of claim 5, wherein the surface voltage health meter is in communication with a network and with a display of the at least one client device, providing a message to the display of the at least one client device through the network.

7. The system of claim 5, wherein the surface data storage comprises a plurality of calibration values for the energy storage device and computer instructions to instruct the surface processor to compare the voltage signals to the plurality of calibration values to determine if the energy storage device is operating within specifications.

8. The system of claim 5, wherein the surface data storage comprises:

a. a plurality of known voltages for each of the piezoelectric strands; and b. computer instructions to instruct the surface processor to compare voltages transmitted by the plurality of electrodes to a power conditioning circuit to the plurality of known voltages to determine if one or more of the piezoelectric strands has suffered disconnection of the piezoelectric strand bundle or the plurality of piezoelectric strand bundles from the pendulous member.

9. The system of claim 1, wherein the pressure housing is adapted to sustain an external pressure of at least 20,000 psi while simultaneously maintaining an internal pressure of about 1 atm.

10. The system of claim 1, wherein the at least one energy storage device comprises a high temperature electrolytic double layer capacitor, wherein the high temperature electrolytic double layer capacitor is configured to sustain operating temperatures from −40 degrees Celsius to 300 degrees Celsius without being damaged.

11. The system of claim 1, comprising a plurality of energy storage devices, wherein the energy storage devices are connected in series.

12. The system of claim 1, wherein the piezoelectric strands are comprised of a piezoelectric fiber-composite material.

13. The system of claim 1, wherein the piezoelectric strands are disposed equidistantly around the pendulous member.

14. The system of claim 1, wherein the pendulous member is a dog bone shape, a cylinder shape, a ball on a rod shape, an extended longitudinally curvilinear object, a cable with a freely swinging deadweight, or combinations thereof.

15. The system claim 1, further comprising a weight secured to at least one of:

a. each of the piezoelectric strand bundles; and b. the pendulous member; and to increase the coefficient of transfer of energy from each of the piezoelectric strands to the plurality of electrodes.

* * * * *